United States Patent [19]

Gierek et al.

[11] 4,158,710

[45] Jun. 19, 1979

[54] METHOD OF PREPARATION OF THE SURFACES OF PRODUCTS MADE OF IRON ALLOYS, PRECEDING THE PROCESS OF HOT-DIP ALUMINIZING

[75] Inventors: Adam Gierek; Lech Bajka; Danuta Adamczyk, all of Katowice, Poland

[73] Assignee: Politechnika Slaska im. Wincentego Pstrowskiego, Gliwice, Poland

[21] Appl. No.: 865,780

[22] Filed: Dec. 29, 1977

[30] Foreign Application Priority Data

Dec. 31, 1976 [PL] Poland .....194998

[51] Int. Cl.[2] ..... C23C 1/08; C23C 1/12

[52] U.S. Cl. ..... 427/310; 134/3; 148/23; 148/26; 156/664; 427/320; 427/329

[58] Field of Search ..... 427/310, 320, 329; 156/664; 134/3; 148/23, 26

[56] References Cited

U.S. PATENT DOCUMENTS

| | | | |
|---|---|---|---|
| 2,731,362 | 1/1956 | Brondyke | 427/310 |
| 2,785,084 | 3/1957 | Lundin | 427/310 |
| 2,935,419 | 5/1960 | Mitchell | 427/310 |
| 3,793,221 | 2/1974 | Otrhalek et al. | 134/3 |
| 3,806,356 | 4/1974 | Shoemaker | 427/310 |
| 3,850,699 | 11/1974 | Gierek et al. | 148/6.27 |

FOREIGN PATENT DOCUMENTS

| | | | |
|---|---|---|---|
| 49131 | 1965 | Poland. | |
| 53084 | 1967 | Poland. | |
| 270430 | 12/1970 | U.S.S.R. | 427/310 |

*Primary Examiner*—John D. Smith
*Attorney, Agent, or Firm*—Haseltine, Lake & Waters

[57] ABSTRACT

The work-pieces are mechanically cleaned, degreased and washed, and then etched in an aqueous solution containing 0.5–1.0% by weight of citric acid, and 16–24% by weight of hydrochloric acid, having a temperature of 15°–30° C., preferably of 20°–25° C., for the time of 1–20 minutes, preferably 2–5 minutes, whereafter the work-pieces are neutralized in an aqueous ammonia solution having a concentration not exceeding 1% by weight, at a temperature of 15°–25° C., in a time not shorter than 1 minute. After being washed in water at a temperature not exceeding 35° C. in a time not shorter than 1 minute, they are dipped in an agitated aqueous solution of the flux, containing 1.8–2.5% by weight of potassium fluoride, 0.8–1.5% by weight of sodium fluoride, and 1.5–3.0% by weight of potassium fluorozirconate, having a temperature of 40°–80° C. After at least two minutes of holding in the flux, the work-pieces are dried and finally dipped in a melt of aluminum or alloys thereof. Alternatively a flux having a composition of 1.5–2.0% by weight of potassium fluoride, 1.5–2.0% by weight of sodium fluoride, 6.0–10.0% by weight of sodium tetraborate and 2.5–5.0% by weight of acetic acid, having a temperature of 15°–40° C. may be used, for a period not shorter than 2 minutes.

6 Claims, No Drawings

METHOD OF PREPARATION OF THE SURFACES OF PRODUCTS MADE OF IRON ALLOYS, PRECEDING THE PROCESS OF HOT-DIP ALUMINIZING

This invention relates to a method of preparation of surfaces of products made of iron, nickel and chromium alloys, preceding hot-dip aluminizing or allitizing.

Adequate preparation of the surface constitutes necessary condition for obtaining diffusion coatings of proper quality. The surface treatment is intended to completely remove oxide layers, non-metallic impurities, fats and moisture, as well as to protect them against secondary oxidation in order to provide a direct contact between the product being immersed in the bath and the molten metal, said contact assuring the mutual diffusion of atoms between the solid and the liquid phases. PL-PS (Polish Patent Specification) 530584 discloses a method consisting of mechanical cleaning, degreasing, etching, washing and drying, and immediate dipping into a melt of aluminum alloys.

Said known method has a number of disadvantages, among others the possibility of repeated oxidation of surfaces of thin-walled work-pieces, and especially those having larger surfaces dipped parallel to the bath-level, due to rapid radiation-type heating from the melt, or the necessity of aluminizing instantly after the etching process, and thus the impossibility of inter-operational storing of work-pieces having the surfaces prepared, before aluminizing them, which in a manufacturing process on a large scale is sometimes unavoidable.

PL-PS 49151 discloses a flux, in the form of an aqueous solution containing 25% of acetic acid or lactic acid, 3% of boric acid and 2% of potassium chloride, the application temperature whereof is 100° C.

The method of hot-dip aluminizing connected with simultaneous heat treatment is also known from PL-PS 69244 and 94340, which however do not disclose the method of preparation of the surface.

The known methods do not specify precisely the parameters of the treatment preceding the flux application, that is of degreasing, etching and washing the work-pieces after etching, and especially the types of etching agents, the concentration thereof, temperature and etching time. Said methods neither specify the time of the flux application operation. The etching operation is of decisive importance for the process of surface treatment of work-pieces made of iron, nickel and chromium alloys, preceding the aluminizing, since it should assure the direct contact of the chemically pure metal of the base with the melt the Al alloy, whereby an unskilled worker conducting the operation can cause formation of a passive layer from the melt, or hydriding of the surfacial zone of the work-piece to be coated, hindering the diffusion of Al from the melt.

The method of preparation of the surfaces of products according to the invention consists in the consecutive operations of mechanical cleaning of the work-pieces, degreasing and washing, and then in etching in an aqueous solution containing 0.5–1.0% of citric acid ($C_6H_8O_7$) and 16–24% of hydrochloric acid (HCl), having a temperature of 15°–30° C.

The time of etching, depending upon the temperature of the etching solution and the degree of corrosion of the surface of the work-pieces to be etched, is of from 1 to 20 minutes, whereby for a solution having a temperature of 20°–25° C. the time of etching is preferably from 2 to 5 minutes. An etching time shorter than the specified range results in leaving on the surface of the work-piece a portion of oxides which during dipping into the melt act as screens and hinder formation of the diffusion coating of aluminum. An etching time longer than the specified range results in excessive etching of one of the structural components of the metal base in relation to the remaining ones, or in etching at the grain limits, which causes the settling of etching products, as for instance iron chloride, in micro-irregularities of the surface, said products forming a barrier for the diffusion of aluminum atoms from the melt into the base to be coated, and resulting in forming a discontinuity of the aluminum coating. Limiting the temperature of etching to the range of 15°–30° C. is dictated by the intention to increase the activity of said treatment by an increase over 15 oC, and to avoid the hydriding of the surface zone of the work-piece being etched through limiting the increase of the temperature of the etching solution over 30° C. The nitrogen evolving again after dipping the etched work-pieces into the aluminum melt causes punctures of the aluminum coating to cause pitting in course of service thereof in a corrosive medium. The increase of the temperature of the etching solution above 30° C. is also disadvantageous due to excessive evaporation thereof. The addition of citric acid in the etching solution in an amount of 0.5–1.0% stabilizes the process of etching in the HCl solution, which means it exhibits on the one hand an inhibiting action, making it impossible for excessive quantities of Fe, Cr or Ni to pass into the solution, whereas on the other hand it facilitates an uniform etching of oxides from the entire surface of the work-piece to be coated, thus said procedure protects the coating against forming discontinuities.

After the etching operation a neutralization of the work-pieces is carried out in a 1% by weight of aqueous ammonia solution at a temperature of 15°–25° C. The neutralization accelerates the operation of washing the work-pieces after etching, and reduces the consumption of washing water. After neutralization the work-pieces are washed in water having a temperature below 35° C. Maintaining the temperature of the wash water below 35° C. makes it possible to avoid the secondary oxidation of surfaces being etched previously. Both the washing time and the neutralization time should be not shorter than 1 minute. Immediately after neutralization and washing of the etched work-pieces the flux application operation is carried out in an aqueous solution of the flux, containing 1.5–3.0% by weight of potassium fluorozirconate, 1.8–2.5% by weight of potassium fluoride, and 0.8–1.5% by weight of sodium fluoride, at a temperature of 40°–80° C., or in an aqueous flux solution containing 6–10% by weight of sodium tetraborate, 1.5–2% by weight of sodium fluoride 1.5–2% by weight of potassium fluoride and 2.5–5% by weight of acetic acid, at a temperature of 15°–40° C.

For the first flux application bath it is necessary to employ a temperature range of 40°–80° C. due to too weak solubility of the potassium fluorozirconate in water at room temperature. On the other hand the temperature of the flux based on sodium tetraborate is maintained within the range of 15°–40° C. because of its better solubility in water. Employing higher temperatures in case of both fluxes intensifies the process, thus permitting a reduction of the time of flux application to the range of 2 to 10 minutes. In case of work-pieces having a strongly profiled and developed surface it is recommended either to stir the solution by one of the known methods or to cause an intensive motion of the work-pieces to be fluxed in the solution in order to assure contact with the flux solution on the entire surface area of the work-piece, and especially on the zones having the most complicated shapes.

The method according to the invention consists in employing in the aqueous flux solution both the mixture of potassium fluorozirconate with sodium fluoride and potassium fluoride, and the mixture of sodium tetraborate with sodium fluoride and potassium fluoride. Employing said additives decreases the melting point of the mixture of fluxing salts up to the range of 600°–650° C., which makes it possible to remove completely the flux film from the surface of the work-pieces in course of dipping them into the melt of aluminum or its alloys, and thus assures the continuity of the coating being formed. Employing mixtures of said salts as fluxes, also increases the wettability of the work-piece surface with the Al bath, and protects it simultaneously against secondary oxidation both in the course of storage between the operations and in the course of dipping into the metal bath.

Employing mixtures of $K_2ZrF_6$ with NaF and KF, and of $Na_2B_4O_7$ with NaF and KF avoids the disadvantages encountered when employing fluxes containing salts having too high a melting point, such as, for example, aqueous solutions of $K_2ZrF_6$ or $Na_2B_4O_7$ exclusively.

The method according to the invention provides for putting in motion of the flux solutions or of the fluxed work-pieces, and also specifies precisely the fluxing time and the temperature of the flux solutions. Moreover, the method according to the invention affords possibilities for complex treating of the operation of surface preparation, including an exact determination of the parameters of all constituent operations that is of etching, neutralizing, washing and fluxing.

EXAMPLE 1

A work-piece made of constructional low-carbon steel having a ferritic-and-pearlitic structure, containing 3% of C, subjected previously to abrasive-blast treatment, is degreased in a bath of trichloroethylene, intensified with ultrasound, at a temperature of 20° C., for a period of 1 min, and further it is washed, dried and etched by dipping in an aqueous solution containing 1% by weight of citric acid and 24% by weight of hydrochloric acid, at a temperature of 20° C., for a period of 2 minutes. Then it is neutralized in an aqueous solution, having a concentration of 1% by weight of ammonia, at a temperature of 20° C. for 1 minute. After neutralization the work-piece is washed in water at a temperature of 30° C. for 2 min, and subsequently it is dipped in a vigorously stirred solution of flux containing 2.5% by weight of potassium fluoride, 1.5% by weight of sodium fluoride, and 3% by weight of potassium fluorozirconate, having a temperature of 40° C. After 3 minutes the work-piece is transferred into a drier, and then dipped in a metal bath composed of aluminum or its alloys.

EXAMPLE 2

A work-piece made of steel of the grade H25N2OS2, containing 25% Cr, 20% Ni, and 2% Si, is cleaned mechanically in a shot-blast machine, and then degreased in trichloroethylene, whereafter for 1.5 min it is etched in an aqueous solution containing 20% by weight of hydrochloric acid, at a temperature of 22° C. The neutralization is carried out in 5% aqueous solution of ammonia at a temperature of 17° C. for 2 minutes. After neutralization the work-piece is washed in water at a temperature of 30° C. for 2 minutes, and then the work-piece is dipped into an agitated flux solution having a temperature of 50° C., for 4 minutes, said flux solution containing 2.0% by weight of potassium fluoride, 1.1% by weight of sodium fluoride and 2.2% by weight of potassium fluorozirconate. After fluxing the work-piece is dried and aluminized.

EXAMPLE 3

A work-piece made of constructional low-carbon (0.3% C) steel having a ferritic-and-pearlitic structure is cleaned mechanically and then degreased and washed by one of the known methods. Then the work-piece is dipped in a mixture having a temperature of 25° C. and containing 0.5% by weight of citric acid and 18% by weight of hydrochloric acid, for 3 minutes. After etching the work-piece is carried over to a 0.75% aqueous solution of ammonia, having a temperature of 20° C., and after 1-minute neutralization it is washed in water heated up to a temperature of 35° C. during a period of 1 minute. Thereafter the work-piece is carried over into an intensively agitated fluxing bath, having a temperature of 80° C. and consisting of 1.8% by weight of potassium fluoride, 0.8% by weight of sodium fluoride and 1.5% by weight of potassium fluorozirconate, wherein it is held for 5 minutes. Then the work-piece is dried and aluminized.

EXAMPLE 4

A work-piece made of steel of the grade H25N2OS2 is cleaned mechanically, and then degreased and washed by one of the known methods. Thereafter the work-piece is carried over into a etching bath having the temperature of 24° C., being an aqueous solution of 0.6% by weight of citric acid and 20% by weight of hydrochloric acid, for a period of 4 minutes. After being etched the work-piece is neutralized in an aqueous solution of ammonia having a temperature of 15° C. and a concentration of 1%, during a period of 1.5 min, and then it is washed in water having a temperature of 20° C. for 3 minutes. Then the work-piece is carried over into the aqueous solution of flux, containing 1.7% by weight of potassium fluoride, 1.7% by weight of sodium fluoride, 7% of borax, and 28% by weight of acetic acid, having a temperature of 40° C., and moving it vigorously it is left in the flux for 1 minute. After removing from the flux the work-piece is transferred into a drier, and after drying it is aluminized.

EXAMPLE 5

A work-piece made of constructional low-carbon steel, of carbon content of 0.3%, having a ferritic-and-pearlitic structure is subjected to machining and then to degreasing. The etching is conducted in an aqueous solution containing 0.8% by weight of citric acid and 21% by weight of hydrochloric acid, at a temperature of 22° C. for 4 minutes. Then the work-piece is neutralized in a 0.5% aqueous solution of ammonia, having a temperature of 17° C., for 2 minutes and washed for 2 minutes in warm water having a temperature of 30° C. Then the work-piece is carried over into the etching bath, having a temperature of 35° C., being a vigorously stirred aqueous solution of 1.8% by weight of potassium fluoride, 1.8% by weight of sodium fluoride, 9.0% by weight of borax and 3% by weight of acetic acid, wherein it is dipped for 2.5 minutes. After removal from the flux the work-piece is dried and then aluminized.

EXAMPLE 6

A work-piece made of steel of the grade H25N2OS2 is cleaned mechanically by an abrasive-blast treatment, and then degreased by one of the known methods. After washing, the work-piece is carried over to the etching bath being a mixture of acids, and containing 1% by weight of citric acid and 23% by weight of hydrochloric acid. The etching is conducted at a temperature of 21° C. for a period of 3 minutes. After etching the work-piece is neutralized in 0.75% aqueous ammonia solution having a temperature of 20° C., for 1 minute, and then it is washed for 1 minute in water having a temperature of 35° C. The fluxing is conducted for 2 minutes under vigorous moving of the work-piece in a bath having a temperature of 17° C., and containing 2% by weight of sodium fluoride, 2% by weight of potassium fluoride, 10% by weight of borax, and 5% by weight of acetic acid. After being fluxed the work-piece is dried and aluminized.

What is claimed is:

1. A method for treatment of a work-piece made of an iron alloy, said method comprising the steps of mechanically cleaning said work-piece, degreasing and washing the cleaned work-piece, etching the washed work-piece in an aqueous solution comprising 0.5–1.0% by weight of citric acid and 16–24% by weight of hydrochloric acid at a temperature of 15°–30° C. for 1–20 minutes, neutralizing the etched work-piece in an aqueous solution of ammonia having a concentration not exceeding 1% by weight at a temperature of 15°–25° C. for not less than 1 minute, washing the neutralized work-piece in water at a temperature not exceeding 35° C. for not less than 1 minute, dipping the neutralized washed work-piece in an agitated flux solution comprising 1.8–2.5% by weight of potassium fluoride, 0.8–1.5% by weight of sodium fluoride, and 1.5–3.0% by weight of potassium fluorozirconate at a temperature of 40°–80° C. for at least 2 minutes, and drying the fluxed work-piece.

2. The method of claim 1 wherein the etching step is carried out at 20°–25° C. for 2–5 minutes.

3. The method of claim 1 further comprising the step of dipping the dried work-piece in a melt of aluminum or an aluminum alloy.

4. A method for treatment of a work-piece made of an iron alloy, said method comprising the steps of mechanically cleaning said work-piece, degreasing and washing the cleaned work-piece, etching the washed work-piece in an aqueous solution comprising 0.5–1.0% by weight of citric acid and 16–24% by weight of hydrochloric acid at a temperature of 15°–30° C. for 1–20 minutes, neutralizing the etched work-piece in an aqueous solution of ammonia having a concentration not exceeding 1% by weight at a temperature of 15°–25° C. for not less than 1 minute, washing the neutralized work-piece in water at a temperature not exceeding 35° C. for not less than 1 minute, dipping the neutralized washed work-piece in an agitated flux solution comprising 1.5–2.0% by weight of potassium fluoride, 1.5–2.0% by weight of sodium fluoride, 6.0–10.0% by weight of sodium tetraborate and 2.5–5.0% by weight of acetic acid at a temperature of 15°–40° C. for at least 2 minutes, and drying the fluxed work-piece.

5. The method of claim 4 wherein the etching step is carried out at 20°–25° C. for 2–5 minutes.

6. The method of claim 4 further comprising the step of dipping the dried work-piece in a melt of aluminum or an aluminum alloy.

* * * * *